United States Patent [19]

Hall

[11] 4,086,931

[45] May 2, 1978

[54] UMBRELLA SHELTER

[75] Inventor: Warren E. Hall, Salem, Oreg.

[73] Assignee: Sports-Brella Inc., Salem, Oreg.

[21] Appl. No.: 803,273

[22] Filed: Jun. 3, 1977

Related U.S. Application Data

[63] Continuation-in-part of Ser. No. 689,458, May 24, 1976, abandoned.

[51] Int. Cl.[2] ..... A45F 1/04; A45F 11/00

[52] U.S. Cl. ..... 135/20 A; 135/2

[58] Field of Search ..... 135/20 A, 2, 16; 297/184

[56] References Cited

FOREIGN PATENT DOCUMENTS 62,320 11/1913 Austria ..... 135/2

*Primary Examiner*—Werner H. Schroeder
*Assistant Examiner*—Conrad L. Berman
*Attorney, Agent, or Firm*—Lee R. Schermerhorn

[57] ABSTRACT

A rectangular umbrella has its supporting pole positioned at the middle of the back edge so as not to obstruct the space under the umbrella. A vertical sheet of fabric hangs from the back edge and portions of the side edges of the umbrella. This partial enclosure is completed by a removable front panel having a transparent upper portion and attachment means for connection with the umbrella and forward side edges of said vertical back fabric. The umbrella pole may be mounted on a stadium bench for sports spectators, on a boat seat for fishermen or duck hunters, or thrust into the ground for bird and big game hunters.

11 Claims, 11 Drawing Figures

FIG. 1
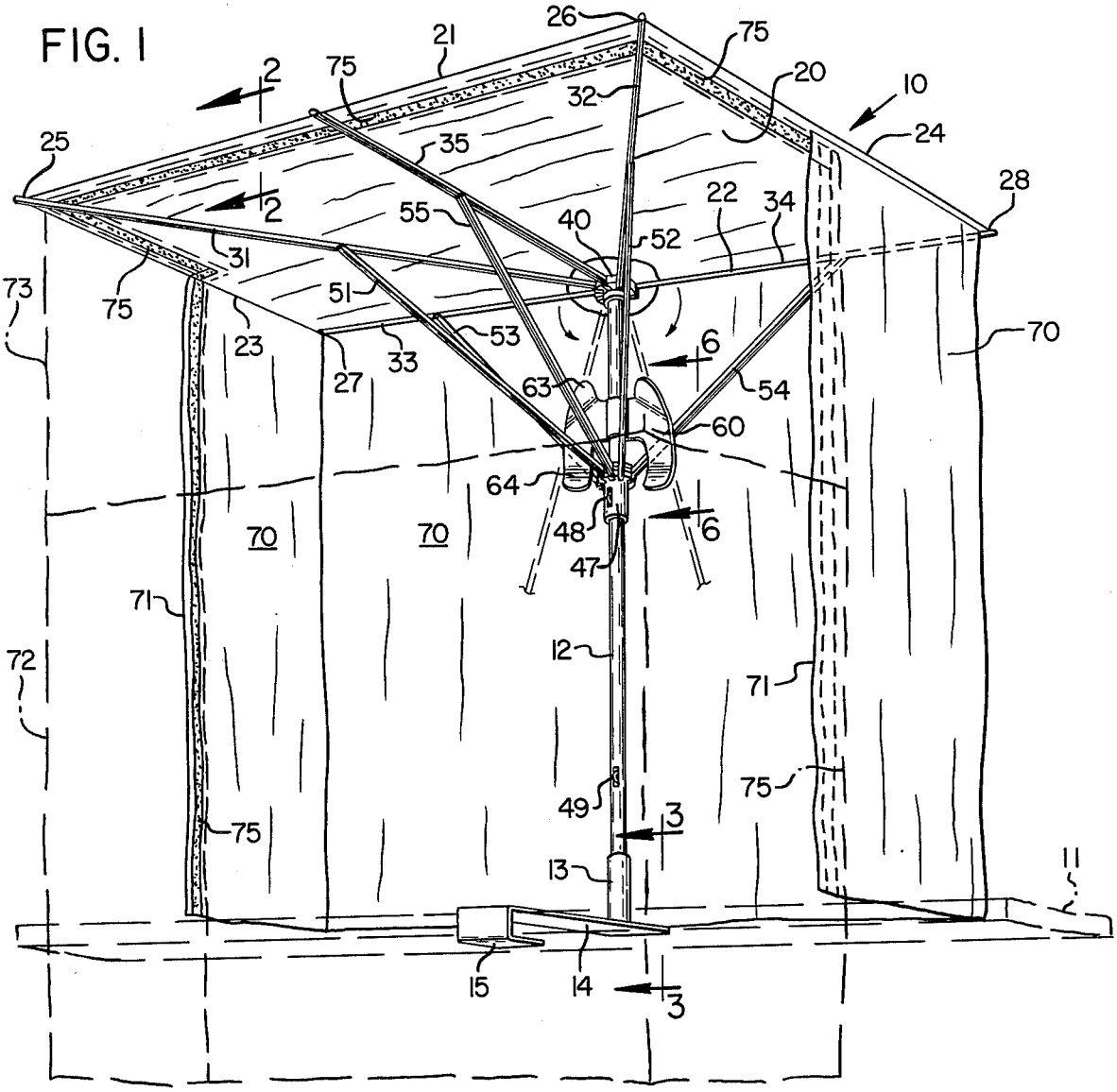
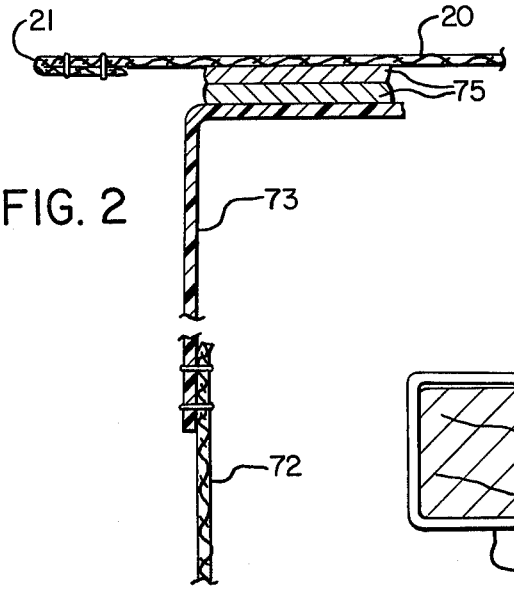
FIG. 2
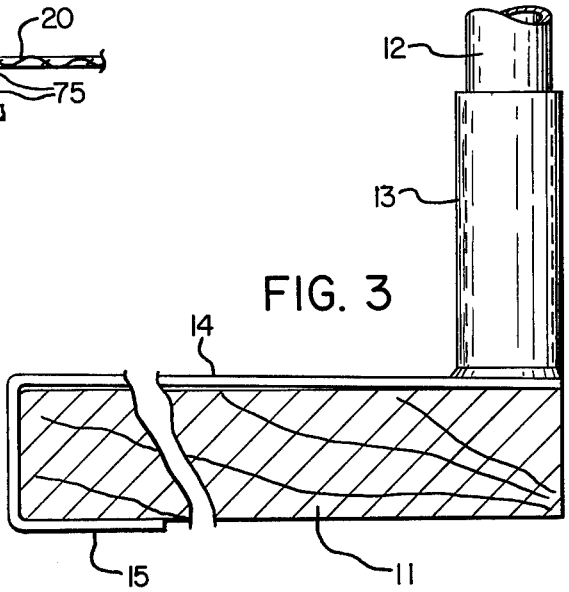
FIG. 3

UMBRELLA SHELTER

CROSS-REFERENCE TO RELATED APPLICATION

This application is a continuation-in-part of my application Ser. No. 689,458 filed May 24, 1976, now abandoned.

BACKGROUND OF THE INVENTION

This invention relates to a portable and collapsible umbrella shelter for use on a stadium bench or in other situations where persons may wish to have protection from the weather.

Portable, collapsible shelters heretofore proposed for this purpose have been too complicated and expensive to be practical. For use on a stadium bench, such a shelter must have a rectangular shape because of the necessarily compact seating arrangement of the spectators. Umbrella type shelters heretofore proposed for other purposes are not suitable for use in a stadium because they do not lend themselves to a close seating arrangement of spectators and because the space under a conventional umbrella is obstructed by its supporting pole.

Objects of the present invention are therefore to provide an improved umbrella shelter which is suitable for stadium use, to provide an umbrella shelter in which the supporting pole does not obstruct the space under the umbrella, to provide an umbrella shelter which is also suitable and advantageous for various other types of use and to provide a construction of the type described which is light in weight, inexpensive to manufacture, easy to erect and easy to collapse into a compact package.

SUMMARY OF THE INVENTION

The present umbrella is rectangular in order to accommodate two people seated side by side on a stadium bench without interfering with other spectators seated closely on opposite sides and behind the umbrella. In order to provide unobstructed space under the umbrella, its supporting pole is positioned in the middle of the back side. A vertical sheet of fabric hangs from the back edge and portions of the side edges of the umbrella. This partial enclosure is completed by a removable front panel having a transparent upper portion and attachment means for connection with the umbrella and forward side edges of said vertical back sheet. The front panel may be detached at any point for ventilation and its upper portion may be detached and turned down on the laps of occupants.

The umbrella pole is supported by a base which attaches to the bench. For single person occupancy, the umbrella may be square with its pole directly behind the back of the occupant. This is not possible with most other known types of umbrellas because portions of the umbrellas project back of the pole, interfering with spectators to the rear and obstructing the walk way between benches.

The base for the pole is also adapted for mounting on the seat of a boat for use of the shelter by fishermen or for use as a duck blind by duck hunters. A spike may be mounted on the lower end of the umbrella pole permitting it to be thrust into the ground to provide a shelter for hunters on land. Still other uses and adaptations will suggest themselves, making the present shelter useful and advantageous for a considerable variety of purposes.

The invention will be better understood and additional objects and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

BRIEF DESCRIPTION OF THE DRAWINGS

FIG. 1 is a perspective view of an umbrella shelter embodying the invention.

FIG. 2 is a view on the line 2—2 in FIG. 1.

FIG. 3 is a view on the line 3—3 in FIG. 1.

DESCRIPTION OF THE PREFERRED EMBODIMENTS

Figure 4:
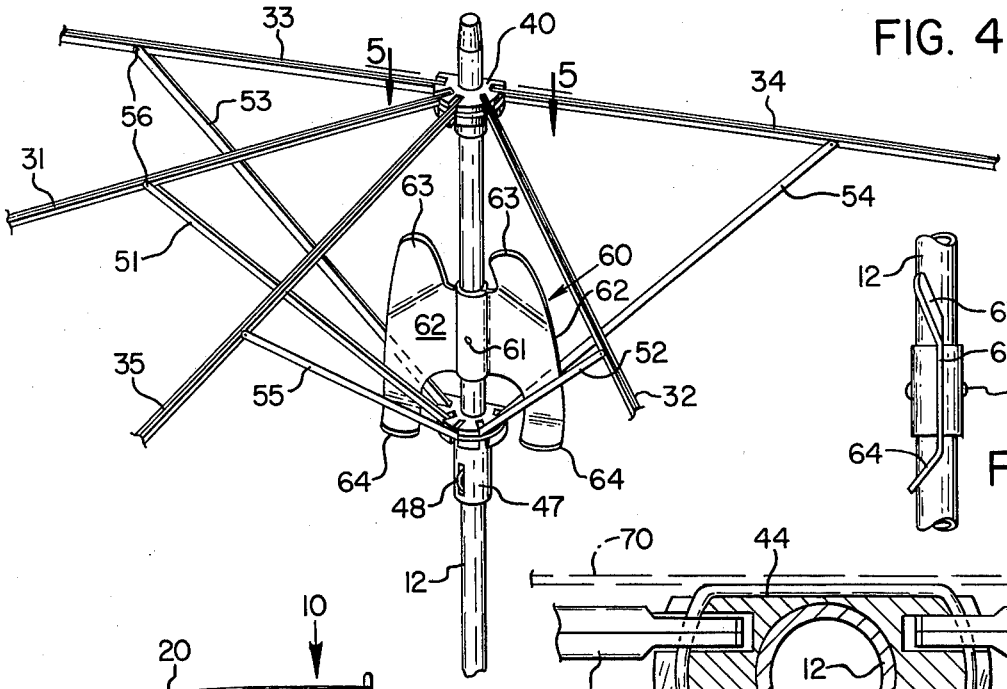
FIG. 4 is a perspective view of the umbrella frame.

FIG. 1 shows a rectangular umbrella shelter 10 for two spectators, mounted on a stadium bench 11. The umbrella pole 12 is inserted in a tubular socket 13 which is upstanding from the back edge of a forwardly extending base member 14. The front end of base 14 has a return bend to provide a flange 15 hooking the front edge of bench 11.

The umbrella frame is covered with a rectangular top piece of fabric 20 having a front edge 21, a back edge 22 and shorter right and left side edges 23 and 24. Thus, the top fabric has two front corners 25 and 26 and two back corners 27 and 28.

As seen in FIGS. 1 and 4, the umbrella frame comprises pole 12, a rib 31 extending to front corner 25, a rib 32 extending to front corner 26, a rib 33 extending to back corner 27, a rib 34 extending to back corner 28 and a rib 35 extending to the middle of front edge 21. These ribs radiate from a top rib holder 40 which is fixedly mounted on the upper end of pole 12.

Figure 5:
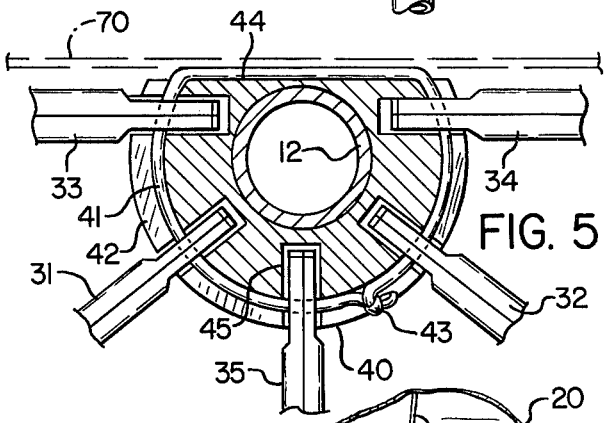
FIG. 5 is a view on the line 5—5 in FIG. 4.

As shown in FIG. 5, the inner ends of ribs 31–35 are pivotally mounted on a wire 41 contained in a circumferential groove 42 in rib holder 40. The ends of wire 41 are secured together at 43 to retain the wire in groove 42. The front side of rib holder 40 is circular, while the back side is flat at 44. The ribs pivot in vertical slots 45 in the rib holder.

It is thus apparent in FIGS. 1, 4 and 5 that back ribs 33 and 34 pivot in a vertical plane through the back edge 22 of rectangular top fabric 20. Back edge 22 of the top fabric extends along and is secured to the ribs 33 and 34 throughout the length of these ribs. When the umbrella is open, the inner ends of ribs 33 and 34 are aligned with each other. The outer ends of these ribs may bow downward to some extent in typical umbrella contour, but nevertheless the entire ribs 33 and 34 lie in a common vertical plane which is a vertical plane through the back edge 22 of the top fabric. This places the pole 12 at the back edge of the umbrella so that the pole does not obstruct the space under the top fabric.

Slide ring 47 is similar to rib holder 40, except that it is formed as a sleeve to slide up and down on pole 12 for opening and closing the umbrella in conventional manner. Pole 12 is provided with an upper spring catch 48 engageable with slide ring 47 to hold the umbrella open and a lower spring catch 49 engageable with the slide ring to hold the umbrella closed as in conventional umbrella construction.

Ribs 31–35 are raised and lowered by strut links 51–55, the upper end of each link being pivotally connected to its corresponding rib at 56. The lower ends of links 51–55 are pivotally connected to slide ring 47 in the same manner that the ribs are pivotally connected to rib holder 40 as shown in FIG. 5. Thus, the back strut links 53 and 54 pivot in a common vertical plane which is the vertical plane of ribs 33 and 34 and the vertical plane through the back edge 22 of the top fabric 20.

For improved durability and stiffness each of the ribs and strut links just described is made as a double rib and double strut link as seen in FIG. 5. For the purpose of the present description, however, each such pair of ribs and strut links will be referred to as a single member.

Means are provided to hold back strut links 53 and 54 and back ribs 33 and 34 in a common vertical plane with the back edge 22 of top fabric 20 when the umbrella is open, to prevent distortion as a result of the tension of the fabric and the eccentric position of pole 12. This holding means comprises a bracket 60 fixedly mounted on pole 12 by screw 61 so that wings 62 extend approximately in the vertical plane of back edge 22 of top fabric 20.

Figure 6:
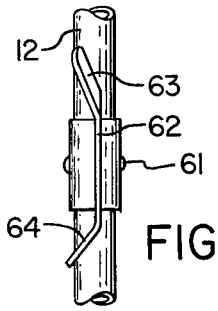
FIG. 6 is a view on the line 6—6 in FIG. 1.

The upper ends 63 and lower ends 64 of wings 62 are bent forward as seen in FIG. 6. When the umbrella is opened, strut links 53 and 54 pass upward behind the wings 62 and are thereby held in the desired common vertical plane as shown in FIGS. 1 and 4 and prevented from swinging forward under the tension of top fabric 20. Strut links 53 and 54 thereby hold ribs 33 and 34 and also the back edge 22 of the top fabric in the desired vertical plane to maintain the rectangular shape of the umbrella without distortion.

When the umbrella is closed, the strut links 53 and 54 slide downward free of the lower ends of wings 62 and ribs 33 and 34 pass downward behind the wings.

Figure 7:
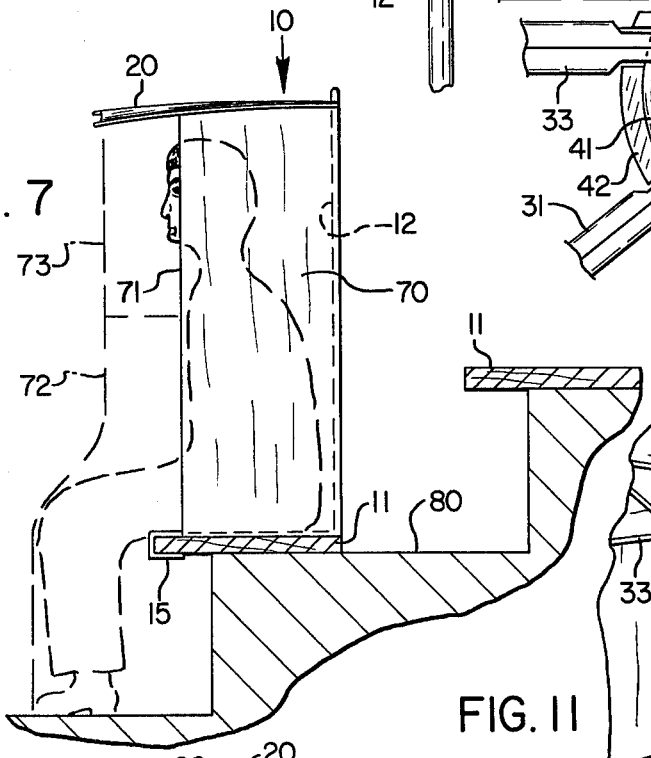
FIG. 7 is a side elevation view of the umbrella shelter mounted on a stadium bench.

A vertical fabric sheet 70 forms back and side portions of the shelter. The upper edge of sheet 70 is permanently connected with back edge 22 and the rear portions of side edges 23 and 24 of top fabric 20 to suspend sheet 70 from the umbrella. Sheet 70 has vertical front edges at 71 on opposite sides of the umbrella. A removable front panel 72 completes the enclosure when desired. Panel 72 has a transparent upper portion 73 forming a window extending across the front of the umbrella and around each side, back to the front edges 71 of back sheet 70. Front panel 72 drapes over the knees and legs of the occupants in front and on opposite sides of the occupants as shown in FIG. 7.

Suitable fastening means are provided for convenient attachment and removal of front panel 72. Such fastening means may comprise slide fasteners, snap fasteners or buttons. A flexible plastic hook and loop fastener sold under the trademark VELCRO manufactured by Velcro, Inc. in Manchester, New Hampshire, may also be used. This fastener material is furnished in strips which may be sewed to the sheets to be fastened together. This type of fastener is secured by merely pressing two of the strips together and it is unfastened by simply pulling them apart.

The fastener strips for front panel 72 are indicated at 75 in FIGS. 1 and 2. Thus, fastener strips 75 extend along front edge 21 and front portions of side edges 23 and 24 of top fabric 20 and along the front edges 71 of back sheet 70. Front panel 72 is provided with fastener strips 75 in corresponding positions so that the fastener strips may be pressed together as shown in FIG. 2. For ventilation, the fastener strips may be separated at any desired point and when desired, the upper portion of panel 72 may be unfastened and folded down over the laps of occupants.

Any suitable fabric may be used for the shelter and the fabric may be coated to make it wind proof or water proof as desired. In preparation for folding the umbrella, the front panel 72 is first removed. When the umbrella is folded, the back sheet 70 may be wrapped around the folded umbrella and then the front panel 72 may be folded separately or wrapped around the folded umbrella and back sheet 70 to make a compact package.

Figure 9:
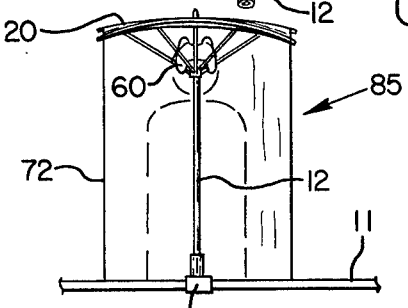
FIG. 9 is a front view of a square umbrella shelter to accommodate a single person.

The present form of construction is particularly well adapted to a square umbrella 85 for single occupancy as shown in FIG. 9. The occupant sits on base 14 to hold the base firmly against bench 11 in the event of wind, making the shelter exceptionally stable under adverse weather conditions. Pole 12 is behind the back of the occupant along side back sheet 70 so that the pole in no way interferes with the occupant. As seen in FIG. 7, no part of the umbrella projects behind pole 12 and bench seat 11 to obstruct the walk way 80 or interfere with the occupants on the next bench to the rear. Any umbrella projecting behind the bench 11 obviously could not be used in a stadium.

Figure 10:
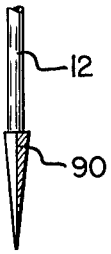
FIG. 10 is an elevation view of an umbrella pole equipped with a spike to be driven into the ground.

In FIG. 10, pole 12 is equipped with a spike 90 to be thrust into the ground to support the umbrella.

Figure 11:
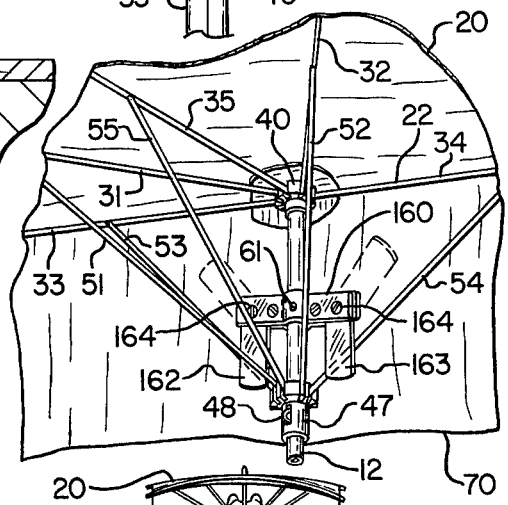
FIG. 11 is a view similar to FIG. 4 showing a modification.
Figure 8:
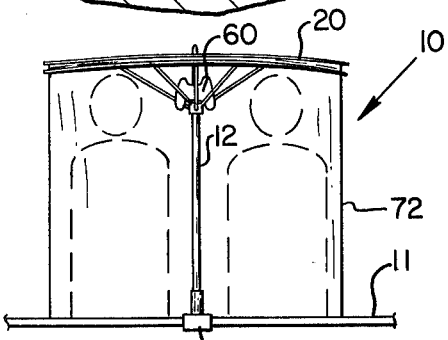
FIG. 8 is a front view.

FIG. 11 shows an alternative form of holding device to hold back strut links 53 and 54 and back ribs 33 and 34 in a common vertical plane with the back edge 22 of top fabric 20 when the umbrella is open, to prevent distortion as a result of the tension of the fabric and the eccentric position of pole 12. This holding means comprises a transverse bracket arm 160 fixedly mounted on pole 12 by screw 61 so as to extend approximately in the vertical plane of back edge 22 of top fabric 20.

The upper ends of depending arms 162 and 163 are mounted on horizontal pivots 164 in the opposite ends of stationary bracket arm 160. When the umbrella is opened, arm 162 is pivoted out in front of strut link 53 and arm 163 is pivoted out in front of strut link 54 to hold these strut links in the desired common vertical plane the same as shown in FIGS. 1 and 4 and prevent them from swinging forward under the tension of top fabric 20. Strut links 53 and 54 thereby hold ribs 33 and 34 and also the back edge 22 of the top fabric in the desired vertical plane to maintain the rectangular shape of the umbrella without distortion. When the umbrella is closed, the strut links 53 and 54 slide downward free of the lower ends of these arms without requiring any manipulation by the operator.

What is claimed is:

1. An umbrella shelter comprising a rectangular top piece of fabric having a back edge, a front edge and two side edges; an umbrella frame having a supporting pole disposed in a vertical plane through said back edge when the umbrella is open, ribs in said frame each hinged at one end to said pole, said ribs comprising a pair of front ribs extending to the front corners of said top fabric and a pair of back ribs in said vertical plane extending along and secured to said back edge of said top fabric and to the back corners of the top fabric; a slide ring on said pole for opening and closing the umbrella; strut links pivotally connected between said slide ring and said ribs including a pair of back strut links movable in said vertical plane; and a holder on said pole between said slide ring and the hinged ends of said ribs engagable with intermediate portions of said back strut links when the umbrella is open to hold said back strut links and back ribs in said vertical plane against the tension of said fabric.

2. An umbrella shelter as defined in claim 1, said holder comprising a bracket secured to said pole, said bracket having a pair of wings projecting laterally from opposite sides of the pole to engage said back strut links.

3. An umbrella shelter as defined in claim 2, said wings having forwardly bent lower ends to cause said back strut links to pass upward behind said wings when the umbrella is opened, and having forwardly bent upper ends to cause said back ribs to pass downward behind said wings when the umbrella is closed.

4. An umbrella shelter as defined in claim 1, said holder comprising a bracket on said pole having a pair of pivot arms arranged to swing in front of said back strut links.

5. An umbrella shelter as defined in claim 4, said pivot arms being positioned so that said back strut links slide free of said arms when the umbrella is closed.

6. An umbrella shelter as defined in claim 1, including a vertical sheet of fabric having a top edge secured to said back edge and portions of said side edges of said top piece with said vertical sheet disposed against said pole.

7. An umbrella shelter as defined in claim 6, including a removable front panel having an upper transparent portion, said front panel having an upper edge with attachment means for connection with said front and side edges of said top fabric and having side edges with attachment means for connection with side edges of said vertical sheet.

8. An umbrella shelter as defined in claim 7, said attachment means comprising strips of hook and loop fasteners on said panel, top fabric and vertical sheet.

9. An umbrella shelter as defined in claim 1, including a holder for mounting on a seat or bench, and a socket on said holder to receive said pole.

10. An umbrella shelter as defined in claim 1, including a spike on the lower end of said pole adapted to be thrust into the ground.

11. An umbrella shelter comprising a rectangular top piece of fabric having a front edge, a back edge and left and right side edges, an umbrella frame having a pair of back ribs extending along an secured to said back edge of said fabric with said ribs disposed in the vertical plane of said back edge when the umbrella is open, a pair of front ribs extending to the front corners of said top fabric, all of said ribs radiating from hinged connections with a pole, said pole being disposed in said vertical plane of said back edge of said top fabric, means to hold said back ribs in said vertical plane against the tension of said fabric when the umbrella is open, said holding means comprising a bracket on said pole engaging strut links for opening and closing the umbrella which are connected to said back ribs, and a pair of pivotal arms on said bracket arranged to swing in front of said strut links to hold said strut links in said vertical plane.

* * * * *